US008143876B2

(12) United States Patent
Kranz et al.

(10) Patent No.: US 8,143,876 B2
(45) Date of Patent: Mar. 27, 2012

(54) DIGITAL REGULATOR IN POWER MANAGEMENT

(75) Inventors: Christian Kranz, Ratingen Lintorf (DE); Christoph Schultz, Bochum (DE); Markus Hammes, Dinslaken (DE)

(73) Assignee: Infineon Technologies AG, Neubiberg (DE)

( * ) Notice: Subject to any disclaimer, the term of this patent is extended or adjusted under 35 U.S.C. 154(b) by 486 days.

(21) Appl. No.: 12/396,921

(22) Filed: Mar. 3, 2009

(65) Prior Publication Data

US 2010/0225295 A1 Sep. 9, 2010

(51) Int. Cl.
*G05F 3/04* (2006.01)
*G05F 3/08* (2006.01)

(52) U.S. Cl. ..... 323/311

(58) Field of Classification Search ..... 323/311–317
See application file for complete search history.

(56) References Cited

U.S. PATENT DOCUMENTS 6,501,256 B1 * 12/2002 Jaussi et al. ..... 323/315
7,173,408 B2 * 2/2007 Huang ..... 323/354

* cited by examiner

*Primary Examiner* — Jue Zhang
(74) *Attorney, Agent, or Firm* — SpryIP, LLC

(57) ABSTRACT

A method and system for controlling a plurality of output voltages.

18 Claims, 4 Drawing Sheets

DIGITAL REGULATOR IN POWER MANAGEMENT

BACKGROUND

A large number of supply voltages may be required in complex technical systems including, but not limited to, mobile phones, digital cameras, and other computing devices, comprising a plurality of differing functional units. Each individual voltage domain often has to satisfy different technical requirements such as output voltage/current, noise, dynamic behavior, etc. To that end, individual analog voltage regulators may be employed, with each analog voltage regulator being individually designed and set. However, if integrated regulators are involved, the designs are redone whenever there is a technological change. Employing individual analog voltage regulators may lead to long design times, risk for redesigns, high current consumption, and large chip area consumption, all of which may be undesirable. Therefore, it is desired to provide an improved voltage regulator system and method of employing the same.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical items.

DETAILED DESCRIPTION

The present disclosure describes a digital voltage regulator multiplex system. Many specific details are set forth in the following description and in FIGS. 1-4 to provide a thorough understanding of various implementations. One skilled in the art will understand, however, that the subject matter described herein may have additional implementations, or that the concepts set forth may be practiced without several of the details described in the following description.

The digital voltage regulator multiplex scheme of the present disclosure employs a central digital control module to control a plurality of output voltages that may be used in devices that require a plurality of supply voltages such as mobile phones, digital cameras, and other computing devices. The central digital control module facilitates a digital voltage regulator multiplex scheme having a smaller "footprint" (chip area employed) as compared with analog regulators. Further, any redesign of the digital voltage regulator multiplex scheme is facilitated by having a central digital control and thus, the digital voltage regulator multiplex scheme is easily transferable between technologies.

Figure 1:
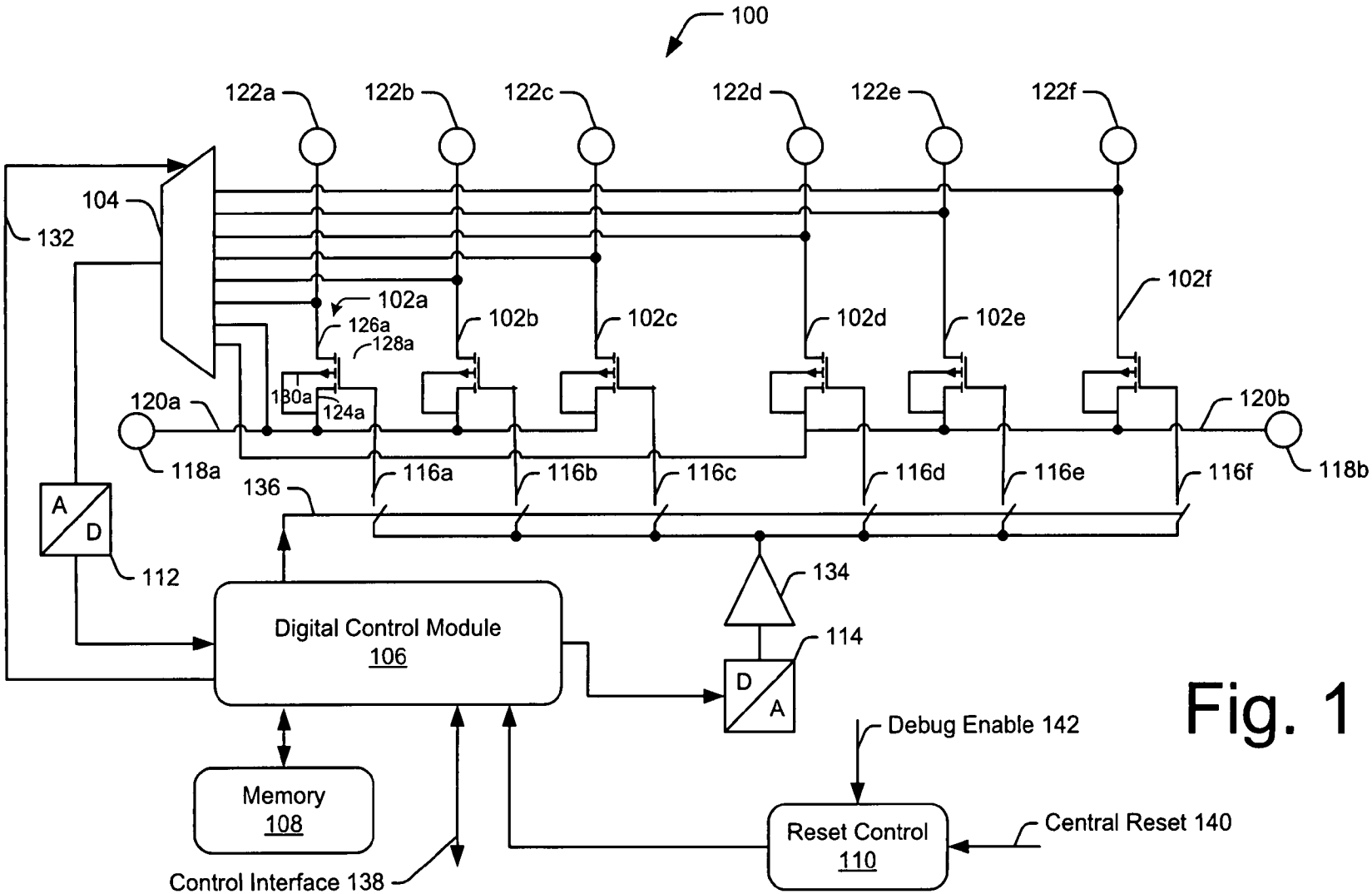
FIG. 1 is a block diagram of a digital voltage regulator multiplex system.

FIG. 1 shows an overview of a system 100 of a plurality of voltage regulators employing a multiplex scheme. System 100 comprises transistors 102*a-f*, multiplexer 104, digital control module 106, memory 108, reset control 110, analog-to-digital converter (ADC) 112, digital-to-analog convertor (DAC) 114, and switches 116. Input to system 100 are input sources 118*a* and 118*b*, however, system 100 may comprise any number of input sources depending on the type of application desired. Input sources 118*a* and 118*b* provide input voltages along paths 120*a* and 120*b* to system 100. System 100 outputs a voltage at output terminals 122*a-f* and maintains a desired constant voltage at output terminals 122*a-f*, described further below. In an implementation, the voltage at output terminals 122*a-f* may have a tolerance of approximately 1%, and in a further implementation, 10%. However, the tolerance may be higher than 10% depending on the application desired.

Transistors 102

In the present example, transistors 102 are p-channel FETs (field-effect transistors), however, transistors 102 may be any type of transistor including, but not limited to, n-channel FETs, npn bipolar transistors, and pnp bipolar transistors. Each of transistors 102 has four terminals associated therewith, terminals 124, 126, 128, and 130. As will be apparent to one skilled in the art from the figures, terminal 124 is the source terminal; terminal 126 is the drain terminal; terminal 128 is the gate terminal; and terminal 130 is the body (or commonly referred to as base, bulk, or substrate) terminal. Transistors 102 establish the state of output terminals 122*a-f*, described further below. For simplicity of illustration, only terminals for transistor 102*a* are noted on FIG. 1.

Input source 118*a* is connected to terminal 124 of transistors 102*a-c*; however, input source 118*a* may be connected to terminal 124 of any subset of transistors 102*a-f*. Further, input source 118*b* is connected to terminal 124 of transistors 102*d-f*. However, input source 118*b* may be connected to terminal 124 of any subset of transistors 102*a-f*. Each of output terminals 122*a-f* of system 100 are connected to terminals 126*a-f*, respectively. Each of switches 116*a-f* of system 100 are connected to terminals 128*a-f*, respectively (with terminals 128*a-f* ultimately being connected to digital control module 106, described further below). Each of terminals 130 are connected to terminals 126.

Multiplexer 104

Multiplexer 104 is configured to selectively output a signal from transistors 102 and input sources 118 determined by digital control module 106. More specifically, multiplexer 104 is connected to terminals 126*a-f* of transistors 102 and input sources 118 such that multiplexer 104 is configured to receive the signal associated with the voltage at terminals 126*a-f* and input sources 118. Further, multiplexer 104 is configured to receive a control signal output via control path 132 by digital control module 106. Based upon the control signal of digital control module 106, multiplexer 104 selects one of the signals associated with the voltage at terminals 126*a-f* and input sources 118 to output such that digital control module 106 receives the signal it selected corresponding to the output at terminals 126*a-f* and input sources 118 via ADC 112. In a further implementation, multiple analog-to-digital converters (not shown) may be employed in place of multiplexer 104.

Digital Control Module 106

Digital control module 106 is configured to control transistors 102 such that a desired constant voltage is maintained at output terminals 122*a-f*, described further below. In a further implementation, the voltage at output terminals 122*a-f* is user defined. Digital control module 106 is connected to terminals 128 of transistors 102 via switches 116. Further, digital control module 106 is connected to switches 116 via DAC 114 and buffer 134. Switches 116 are configured to receive control signals generated by digital control module 106 via control path 136 such that digital control module 106 controls switches 116. More specifically, digital control module 106 controls switches 116 such that any desired combination of switches 116 may be in an "open" state or a "closed" state, as desired. A "closed" state is defined as digital control module 106 being connected to terminals 128 while and "open" state is defined as digital control module 106 not being connected to terminals 128.

Digital control module 106 is further coupled to memory 108 and control interface 138. Memory 108 stores a desired state of output terminals 122*a-f*, described further below. In a further implementation, memory 108 stores the value of the voltage at terminals 128. Control interface 138 provides an interface for a user of system 100.

Reset Control 110

Reset control 110 is configured to receive central reset signal 140 and debug enable signal 142. Central reset signal 140 is used to reset digital control module 106. Often, the generated supply voltage(s) (i.e. input voltages along paths 120*a* and 120*b*) are used in software based systems and debugging of the software may be required. To that end, during debugging of system 100, it is not unusual to reset system 100. In such cases it may be desired to keep the output voltages (i.e. voltages at output terminals 122*a-f* controlled if system 100 is in reset. Therefore, debug enable signal 142 is used to disable the reset of digital control module 106 when a debugger is connected.

Process Model

Figure 2:
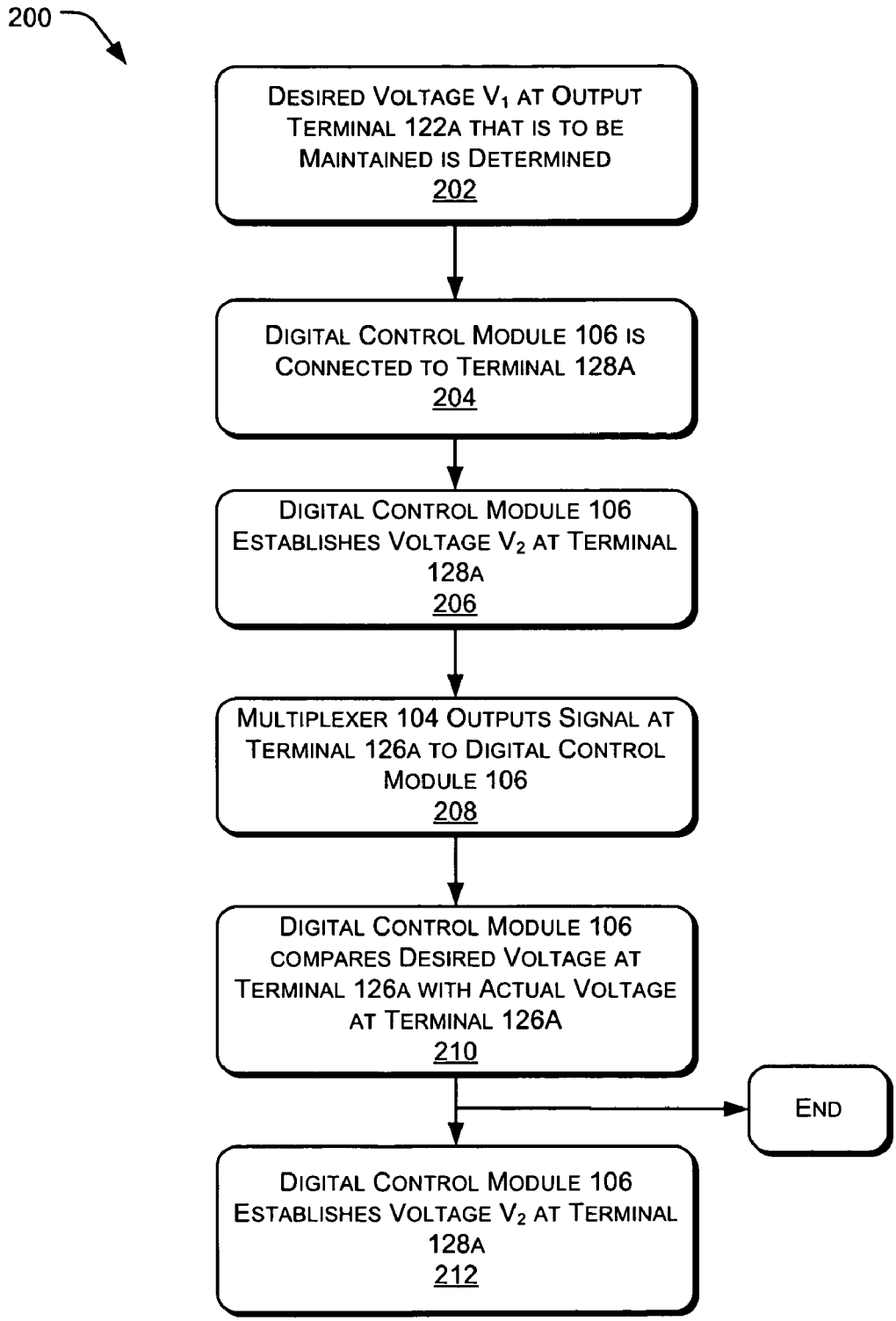
FIG. 2 is a process flow chart of employing the digital voltage regulator multiplex system of FIG. 1.

FIG. 2 shows a process 200 of employing system 100. In process 200, the example is shown with respect to a single transistor (102*a*) of transistors 102. However, process 200 may be applied to all of transistors 102 or any subset (combination) of transistors 102.

At step 202, a desired voltage $V_1$ to be maintained at output terminal 122*a* is determined. Voltage $V_1$ may be determined by a load (not shown) connected to output terminal 122*a*. In a further implementation, voltage $V_1$ may determined by a user employing control interface 138. A magnitude of the desired voltage $V_1$ is stored in memory 108. In a further implementation, the magnitude of voltage $V_1$ is communicated from memory 108 to digital control module 106.

At step 204, digital control module 106 is connected to terminal 128*a* of transistor 102*a* by controlling a state of switch 116*a*. More specifically, digital control module 106 controls the state of switch 116*a* such that switch 116*a* is in a "closed" state. In an implementation, digital control module 106 alters the state of switch 116*a* from an "open" state to a "closed" state. In a further implementation, digital control module 106 maintains the state of switch 116*a* in the "closed" state.

At step 206, digital control module 106 establishes a voltage $V_2$ of terminal 128*a* of transistors 102*a*. More specifically, digital control module 106 communicates with terminal 128*a* of transistor 102*a* via DAC 114 and buffer 134 to establish a voltage $V_2$ of terminal 128*a*. Voltage $V_2$ of terminal 128*a* has a magnitude such that the desired magnitude of voltage $V_1$ is established at output terminal 122*a* (also terminal 126*a* of transistor 102*a*). This voltage $V_2$ is maintained at terminal 128*a* by means of a gate capacitance, or other capacitance, or any other circuit at terminal 128*a*.

At step 208, digital control module 106 selects the signal output at terminal 126*a*. More specifically, digital control module 106 outputs a control signal via control path 132 such that multiplexer 104 selects the signal output at terminal 126*a* with digital control module 106 receiving the signal output at terminal 126*a* via ADC 112.

At step 210, digital control module determines if voltage $V_2$ at terminal 128*a* of transistor 102*a* is to be altered. More specifically, digital control module 106 compares a magnitude of the voltage $V_1$ at output terminal 122*a* (also terminal 126*a*) with the desired magnitude of voltage $V_1$ in memory 108 to define a voltage difference. If the voltage difference is greater than a predetermined value, at step 212, digital control module 106 communicates with terminal 128*a* of transistor 102*a* via DAC 114 and buffer 134 to establish the voltage $V_2$ of terminal 128*a* such that voltage $V_1$ at terminal 126*a* is obtained, analogous to that described above at step 206. If there voltage difference is not greater than a predetermined value/percentage, at step 214, the process is ended. In a further implementation, process 200 may be looped iteratively until a desired voltage is obtained at output terminal 122*a* (also terminal 126*a*). In a still a further implementation, process 200 may be looped iteratively infinitely. In still a further implementation, the signal output at terminals 126*a-f* may be sampled at predetermined time intervals for comparison with desired magnitudes of voltage $V_1$ in memory 108 to determine if alteration of the voltage at terminals 128*a* is needed.

The above process 200 may be applied across all or a portion of transistors 102 in any sequence desired until the desired voltages are obtained at terminals 122. More specifically, digital control module 106 selects a transistor of transistors 102 to control such that voltages at output terminals 122*a-f* are maintained.

Detailed View of Digital Control Module 106

Figure 3:
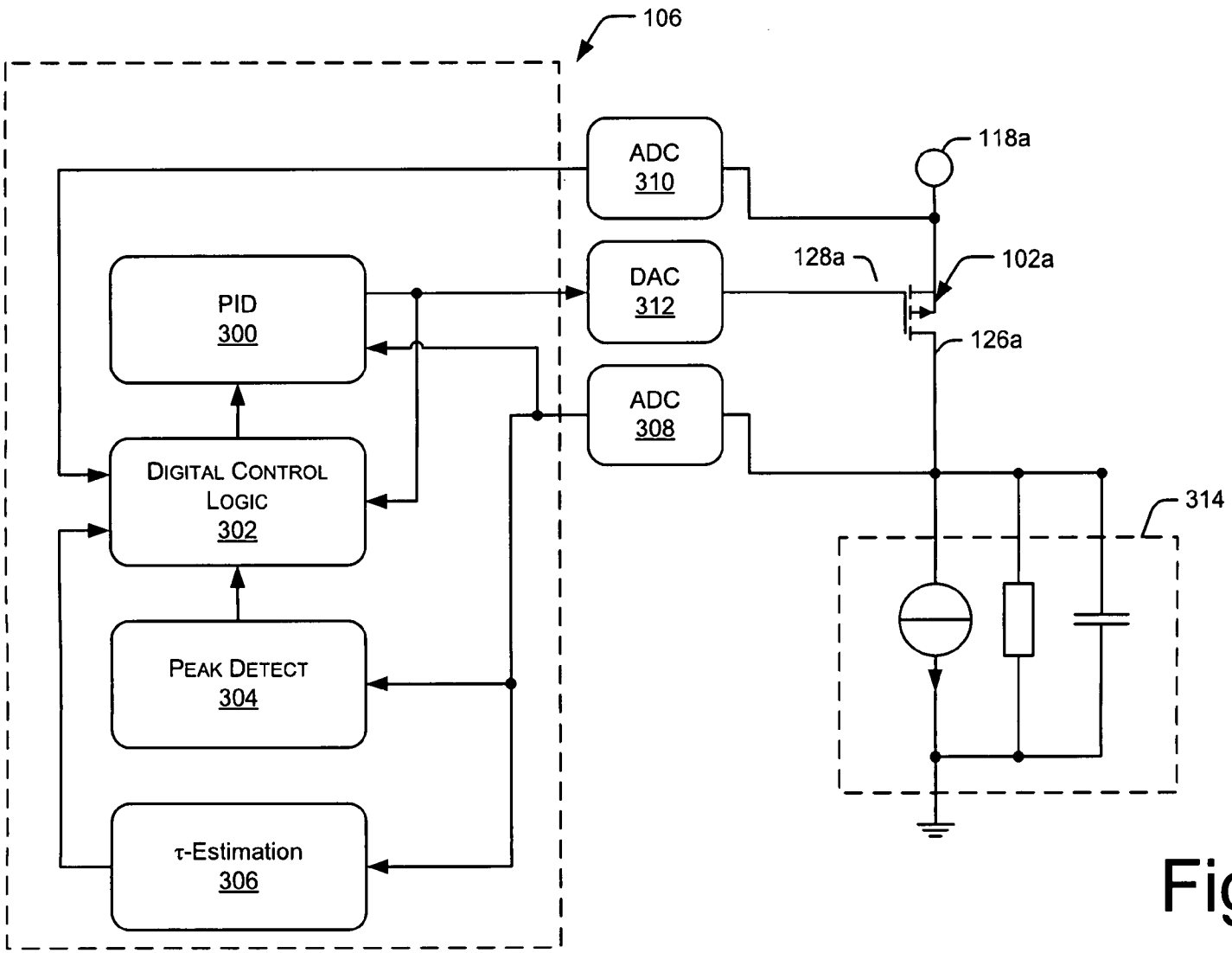
FIG. 3 is a detailed view of a digital control module of the digital voltage regulator multiplex system of FIG. 1

FIG. 3 shows a detailed view of digital control module 106. Digital control module 106 comprises proportional-integral derivative (PID) controller 300, digital control logic module 302, peak detection module 304, and τ-estimation module 306. For simplicity of illustration, only transistor 102*a* is shown, however, any, the following may be applied to all of transistors 102 or any subset (combination) of transistors 102.

Digital control logic module 302 is configured to receive the signal output at input source 118*a* (analogous to receiving the signal through multiplexer 106 as described above with respect to FIG. 1) via ADC 310 (analogous to receiving via ADC 112 as described above with respect to FIG. 1). PID controller 300 is configured to receive the voltage at terminal 126*a* of transistor 102*a* (analogous to receiving the signal through multiplexer 106 as described above with respect to FIG. 1) via ADC 308 (analogous to receiving via ADC 112 as described above with respect to FIG. 1). The load at terminal 126*a* of transistor 102*a* is shown by load 314. To that end, parameters corresponding to the signal output at input source 118*a* and input to digital control logic module 106 are communicated to PID controller 300. PID controller 300 communicates with terminal 128*a* of transistor 102*a* via DAC 312 (analogous to communicating via DAC 114 as described above with respect to FIG. 1) to establish a voltage $V_2$ of terminal 128*a* based upon the parameters passed from digital control logic module 102 to PID controller 300.

Peak detection module 304 is configured to receive the voltage at terminal 126*a* of transistors 102*a* via ADC 308. Peak detection module 304 is employed for detection of rising oscillations of the voltage $V_1$ at terminal 126*a* (as well as other phenomenon) which may indicate an instable system. When, or at about the time that, a peak is detected, coefficients of PID controller 300 may be adjusted to better damp the regulation loop described herein and increase system stability if desired. This information is communicated to digital control logic module 302.

τ-estimation module 306 is configured to receive the voltage at terminal 126*a* of transistor 102*a* via ADC 308. τ-estimation module 306 is employed to estimate the rise time of the voltage $V_1$ at terminal 126*a* after initial activation of system 100. The rise time may be employed to estimate the load characteristics of system 100 and initial selection of coefficients of PID controller 300. This information is communicated to digital control logic module 302.

Peak detection module 304 and τ-estimation module 306 enable system 100 to automatically adapt to different loads at output terminals 122*a-f*. As a result, a single design of system 100 may be employed in multiple different applications.

Detailed View of Further Implementation of Transistors 102

Figure 4:
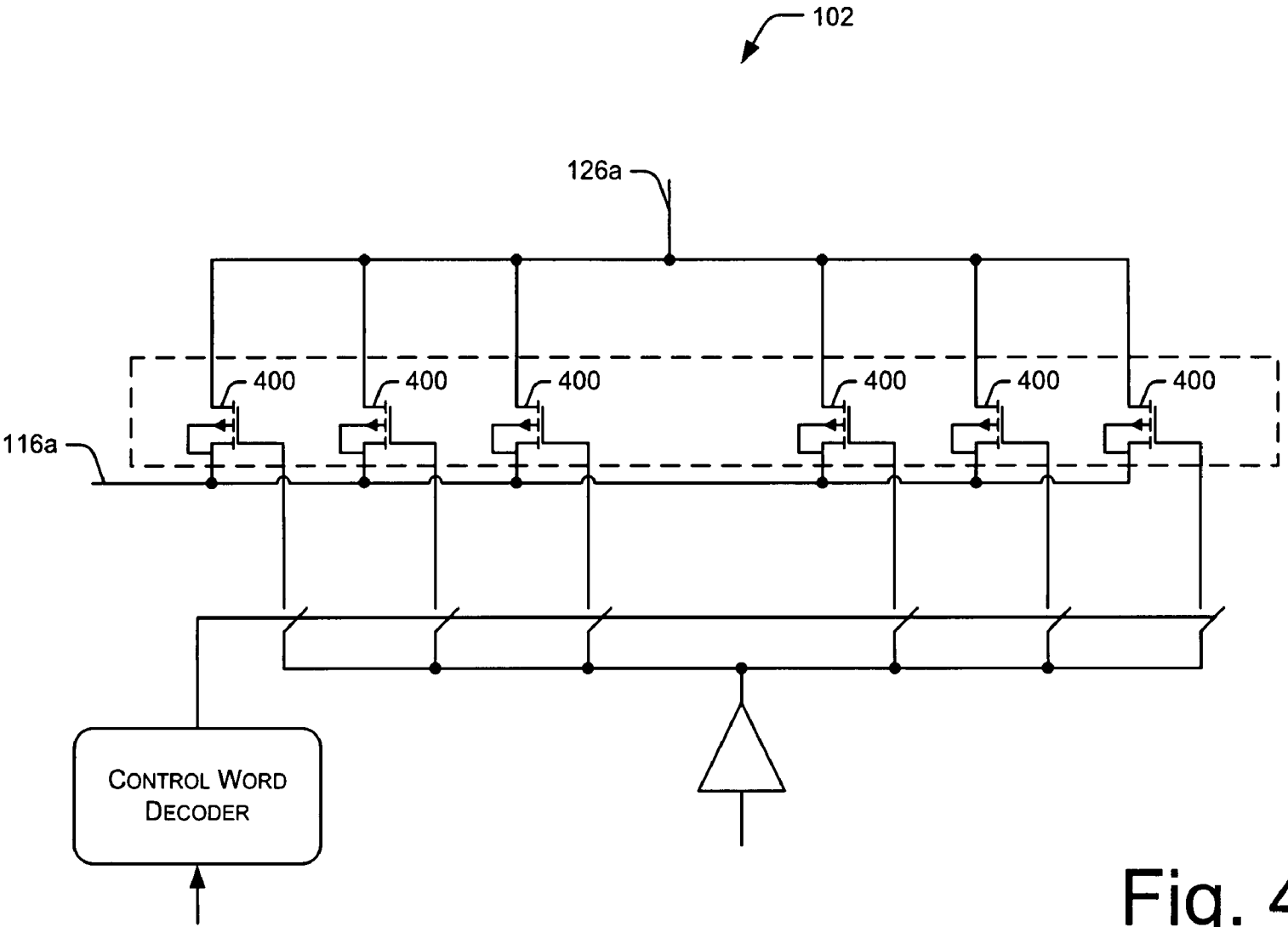
FIG. 4 is a detailed view of one transistor of the transistors of the digital voltage regulator multiplex system of FIG. 1, in a further implementation.

FIG. 4 shows a detailed view of a further implementation of transistors 102. More specifically, each of transistors 102 may be implemented as a plurality of transistors 400 connected in parallel with connected terminals (i.e. the gate, source, drain, and body terminals). The transistors 400 are switched individually resulting in a change of the effective transistor (i.e. transistors 102) width, power density, current carrying capability, etc. of the transistor 102. The width of the transistors 400, at a given voltage between the gate terminal and the source terminal thereof, have a correlation with the current of transistor 400, and thus the switching of transistors 400 may be employed for regulation of the current in place of altering the voltage between the gate and source terminals as discussed with reference to FIGS. 1 and 2. As a result, less area and power may be required as compared with a DAC-PMOS transistor combination.

Benefits of Employing System 100

Employing the aforementioned system 100 and process 200 may offer the following benefits: (1) a single control module (digital control module 106) for each of transistors 102 (i.e. the control loop), however, in a further implementation, digital control module 106 may be implemented as a plurality of digital control modules; (2) individual parameters for each of transistors 102 (i.e. the control loop); (3) digital design may easily be transferred to new technologies; (4) small chip area in comparison with analog regulators (particularly in nanometer technologies); (5) simple low-power mode by clock reductions, no constant bias current; and (6) reduced costs in chip production tests.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A power supply system for controlling one or more output voltages, the system comprising:

a plurality of transistors each having at least an input terminal, an output terminal, and a control terminal, with each of the one or more output voltages being associated with the output terminal of a transistor of the plurality of transistors;

a power input source connected to the input terminal and providing a voltage thereat;

a memory storing desired magnitudes of the one or more output voltages;

a digital control module communicating with the control terminal of each transistor of the plurality of transistors, and further communicating with the memory, with the digital control module being configured to compare a magnitude of the one or more output voltages with the desired magnitude of the one or more output voltages stored in the memory and controlling the voltage at the control terminal of each transistor of the plurality of transistors such that the desired magnitude of the one or more output voltages is established; and a multiplexer connected between the digital control module and the output terminal of the plurality of transistors, with the digital control module providing a control signal to the multiplexer.

2. The system as recited in claim 1, wherein the plurality of transistors are selected from a group of transistors comprising PMOS FET devices, NMOS FET devices, NPN bipolar devices, and PNP bipolar devices.

3. The system as recited in claim 1, wherein the input terminal is a source terminal of the transistor, the output terminal is a drain terminal of the transistor, and the control terminal is a gate terminal of the transistor, with the transistor further having a bulk terminal connected to the input terminal.

4. The system as recited in claim 1, wherein the input source is further connected to the multiplexer.

5. The system as recited in claim 1, further comprising a plurality of analog to digital converters connected between the digital control module and each output terminal of the plurality of transistors.

6. The system as recited in claim 1, further comprising a plurality of switches connected between the control terminal of the plurality of transistors and the digital control module, wherein the digital control module controls a state of the plurality of switches.

7. The system as recited in claim 1, further comprising an analog-to-digital converter connected between the multiplexer and the digital control module.

8. The system as recited in claim 1, further comprising a digital-to-analog converter connected between the digital control module and the control terminal of the plurality of transistors.

9. A method for controlling an output voltage at a plurality of transistors, the method comprising:

for each transistor:

connecting an input voltage source at an input terminal of the transistor;

determining a desired first voltage at an output terminal of the transistor;

connecting a digital control module to a control terminal of the transistor;

establishing a second voltage at the control terminal of the transistor by the digital control module such that a third voltage is established at the output terminal of the transistor;

outputting a magnitude of the third voltage to the digital control module, and further outputting the magnitude of the third voltage for each transistor of the plurality of transistors to a multiplexer, the multiplexer selecting one of the magnitudes associated with the third voltage for each transistor and outputting the magnitude to the digital control module, with the digital control module providing a control signal to the multiplexer;

comparing the desired first voltage with the third voltage by the digital control module to define a difference; and based upon the difference, altering the second voltage at the control terminal of the transistor by the digital control module such the first voltage at the output terminal of the transistor is established.

10. The method as recited in claim 9, further comprising repeating the method iteratively until the desired first voltage at the first terminal is established within a given tolerance.

11. The method as recited in claim 9, further comprising repeating the method iteratively at predetermined time intervals.

12. The method as recited in claim 9, further comprising repeating the method iteratively infinitely.

13. The method as recited in claim 9, wherein the input terminal is a source terminal of the transistor, the output terminal is a drain terminal of the transistor, and the control terminal is a gate terminal of the transistor, with the transistor further having a bulk terminal connected to the input terminal.

14. The method as recited in claim 9, wherein connecting further includes controlling a state of a switch connected to the control terminal of the transistor by the digital control module such that the digital control module is connected to the control terminal of the transistor.

15. The method as recited in claim 9, further including outputting a magnitude of the input voltage source voltage to the multiplexer.

16. A power supply system for controlling a plurality of output voltages, the system comprising:

a plurality of transistors each having at least an input terminal, an output terminal, and a control terminal, wherein each transistor comprises a plurality of transistor elements, the terminals of each transistor element being connected in parallel with like terminals of the remaining transistor elements, with each of the plurality of output voltages being associated with the output terminal of a transistor of the plurality of transistors;

a power input source connected to the input terminal and providing a voltage thereat;

a memory storing desired magnitudes of the plurality of output voltages; and a digital control module communicating with the control terminal of each transistor of the plurality of transistors, and further communicating with the memory, with the digital control module being configured to compare a magnitude of the plurality of output voltages with the desired magnitude of the plurality of output voltages stored in the memory and selectively control the transistor elements connected in parallel at the control terminal of each transistor such that the desired magnitude of the plurality output voltages is established.

17. The system as recited in claim 16, wherein the plurality of transistors are selected from a group of transistors comprising PMOS FET devices, NMOS FET devices, NPN bipolar devices, and PNP bipolar devices.

18. The system as recited in claim 16, wherein the input terminal is a source terminal of the transistor, the output terminal is a drain terminal of the transistor, and the control terminal is a gate terminal of the transistor, with the transistor further having a bulk terminal connected to the input terminal.

* * * * *